United States Patent [19]

Seidel et al.

[11] 4,372,993

[45] Feb. 8, 1983

[54] METHOD FOR MAKING ENAMEL BEADS AND RESULTING PRODUCT

[76] Inventors: Michael J. Seidel, 242 NE. 169th, Portland, Oreg. 97230; Kevin L. Dixon, Rte. 2, Box 1164K, Rosebury, Oreg. 97470

[21] Appl. No.: 219,525

[22] Filed: Dec. 23, 1980

[51] Int. Cl.[3] ..... B05D 3/02; B05D 3/08

[52] U.S. Cl. ..... 427/193; 59/2; 427/204; 427/310; 427/330; 427/374.4; 427/376.4; 428/36

[58] Field of Search ..... 59/2; 427/193, 204, 427/310, 330, 374.4, 376.4, 380; 428/36

[56] References Cited

U.S. PATENT DOCUMENTS

| | | | |
|---|---|---|---|
| 3,508 | 7/1883 | Abel | 427/193 |
| 1,531,613 | 3/1925 | Hommel | 427/193 |
| 3,027,607 | 4/1962 | Badger et al. | 427/193 |
| 3,044,893 | 7/1962 | Heintz et al. | 427/193 |
| 4,209,556 | 6/1980 | Brandeberry et al. | 427/330 |

*Primary Examiner*—Shrive P. Beck

*Attorney, Agent, or Firm*—Blair, Brown & Kreten

[57] ABSTRACT

A method of making an enamel bead and resulting bead which includes the provision of a short length of copper tubing forming a bead core member wherein the copper tubing is heated to a red hot state and rolled in copper enamel flux one or more times to coat the tubing following which the flux coated tubing is again heated to a red hot state and rolled in particulate enamel material to coat the tubing externally with enamel material, then heating the enamel material coating until it melts and is distributed throughout the tubing outer surface in the desired bead configuration and finally cooling the enamel coating to form a highly durable bead having a copper tubing core with an outer layer of enamel of a selected color.

9 Claims, 7 Drawing Figures

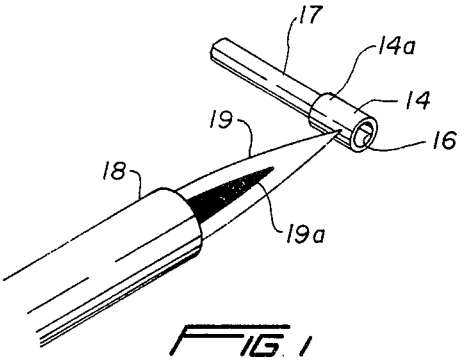
FIG. 1
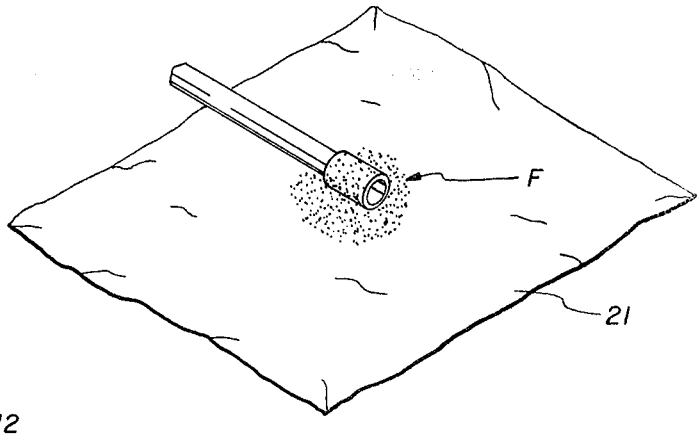
FIG 2
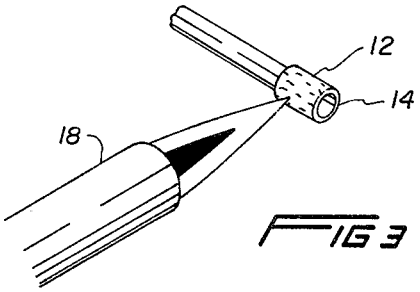
FIG 3
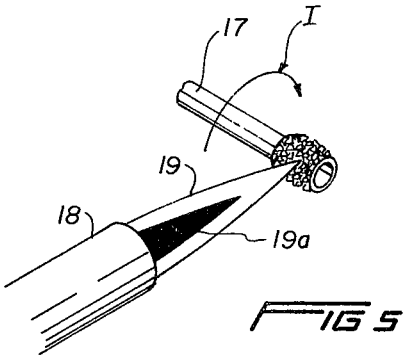
FIG 5
FIG 4
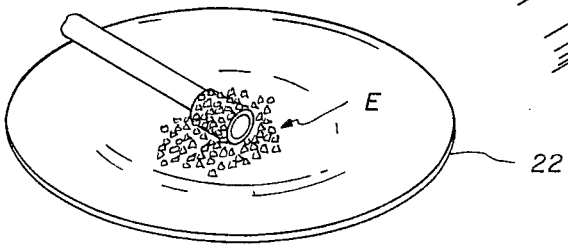
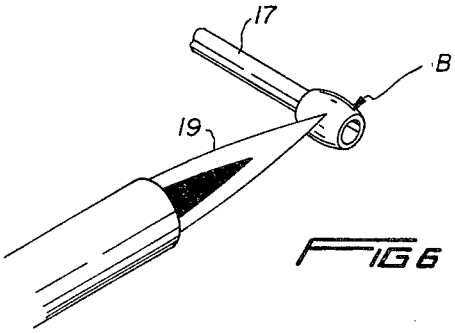
FIG 6
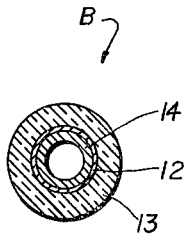
FIG 7

METHOD FOR MAKING ENAMEL BEADS AND RESULTING PRODUCT

BACKGROUND OF THE INVENTION

The art of making glass beads particularly multi-colored glass beads has been highly developed over the years and under most bead production processes in use today a high production rate has been achieved for manufacturing beads formed entirely of glass material with a central bore therethrough for stringing beads on strand material and the like. While the quality of such beads is satisfactory using present day production processes, the problem of maintaining a properly dimensioned central bore to the bead still has not been satisfactorily solved. If the bead bore is non-uniform insertion of the strand material therethrough is difficult and frequently impossible, frustrating the worker or hobbiest and frequently resulting in the bead being discarded. Furthermore, presently produced beads are quite fragile and are easily damaged and even destroyed during use.

The following U.S. Pat. Nos. are representative of the prior art pertaining to the subject matter of the invention:

2,206,597 Canfield et al.
3,169,310 Gibson et al.
3,546,909 Gartrell
3,922,458 Lynch
4,081,575 Sprig The Lynch patent refers to a method of applying a decorative enamel surface to to a steel article in which layers of first and second enamel are applied to a cooking vessel or the like and fused by temperature. The Gartrell patent refers to a process and apparatus for applying vitreous enamel to a preheated metal sheet wound on a coil a dry powder vitreous enamel frit or slip being applied to one or both sides of the heated sheet and melted to form an enamel coating. The Gibson et al. patent relates to the production of vitreous enamel coatings in which a ground-coated metal base is fired in a non-oxidizing atmosphere an adherent type, light blue oxide coating or the like being formed on the surface of the base metal prior to applying the ground coat. The Canfield et al. patent relates to a process of producing an enamel article in which an iron sheet having a cold rolled surface is modified to make it tightly adherent to vitreous enamel which is finally applied to the iron sheet in an enameling step. The Spirig patent relates to a method of flux coating a metal wick in which a wick is heated in a reducing atmosphere and is immersed in a coating bath containing a solution of a rosin flux in an organic solvent, the solvent being subsequently evaporated.

OBJECTS AND SUMMARY OF THE INVENTION

Accordingly, a primary object of this invention is to provide a new and novel method of making enamel beads.

Another object of this invention is to provide a new and novel bead having a highly appealing aesthetic appearance and which is extremely durable.

A further object of this invention is to provide a new and novel method of making beads having an enameled outer surface of an unlimited variety of colors and which may be practiced by a relatively unskilled artisan to produce beads highly uniform in construction.

Still another object of this invention is to provide a new and novel bead and a method of making a bead having an enamel coating on a metal tube using relatively inexpensive materials and which may be practiced by hand.

The objects of the invention and other related objects are accomplished by the provision of a tubular core member of metal such as copper or the like and heating the core member to a glowing state. The outer surface of the heated core member is coated with an enamel flux and after reheating to a glowing state a particulate enamel material is applied to the outer surface of the flux coated core member. Subsequently, the core member is rotated and the particulate enamel material applied thereto is heated to a melted condition to uniformly distribute the enamel material on the core member thereby forming a bead of uniform shape which is subsequently cooled.

Other objects and advantages will become apparent in the following specification when considered in light of the attached drawings.

BRIEF DESCRIPTION OF THE DRAWINGS

FIG. 1 is a perspective view showing the first step in the novel method of the invention;

FIG. 2 is a perspective view showing the second step in the novel method of the invention;

FIG. 3 is a perspective view showing the third step in the novel method of the invention;

FIG. 4 is a perspective view showing the fourth step in the novel method of the invention;

FIG. 5 is a perspective view showing the fifth step in the novel method of the invention;

FIG. 6 is a perspective view showing the final step in the novel method of the invention; and FIG. 7 is a sectional view of a bead constructed in accordance with the novel method of the invention.

DESCRIPTION OF THE PREFERRED EMBODIMENTS

Referring to the drawings, there is shown in FIGS. 1–6 the series of steps by means of which the novel method of the invention is carried out to produce a bead designated generally in FIG. 7 by the letter B. In accordance with the novel method of the invention the bead B includes a tubular core member 14 of metal such as copper reference numeral 12 representing an enamel flux layer and an outer layer 13 of enamel of any choice of color or colors. The bead B is preferably is somewhat "barrel" shape as shown in FIG. 6.

Referring now to FIG. 1, the first step in the novel method of the invention is to provide a tubular core member 14 of metal such as copper having a central bore 16 the length of such core member corresponding to the length of the bead to be produced. By way of example, the copper core member 14 may be approximately 0.5 inches in length and with an O.D. of 0.25 inches.

In order to initiate the processing of the core member 14 a rod 17 such as a metal welding rod is inserted at one end within the central bore 16 of the core member 14 to retain the core member 14 in a position for heating by means such as a torch 18. Thus as can be understood, the rod 17 and therefore the core member 14 may be held in one hand of the artisan with the torch 18 which may be a propane torch held in the other hand. The torch 18 when ignited therefore provides, as is well known, a flame 19 having a central blue flame 19*a*.

With the core member 14 on the rod 17 the flame is applied to the core member holding the rod horizontal and level at all times. Preferably, the core member 14 is held just in front of the blue flame 19*a* where the highest temperature prevails. Heating of the core member or tubing 14 is continued until the tubing 14 glows or becomes red-hot.

When the tubing 14 is red-hot, it is removed from the flame and rolled in a supply of enamel flux designated generally in FIG. 2 by the letter F. Preferably, the supply of enamel flux F is copper enamel flux for proper reaction with the copper material 14. The supply of copper enamel flux F is preferably deposited on a sheet 21 of aluminum foil or the like.

In order to completely coat the outer surface 14*a* of the tubing 14 with the flux F the tubing 14 is heated up again and rolled in the flux F about four to five times throughly coating the tubing outer surface 14*a* with the flux F to form the layer 12 of FIG. 7.

When the flux coating 12 has been applied, the tubing 14 is again heated to a glowing or red-hot state using the torch 18 as shown in FIG. 3. When the tubing 14 has reached the red-hot state, it is then rolled in a pile of particulate enamel material of conventional composition designated generally in FIG. 4 by the letter E. The particulate enamel material E may be any well known frit or slip of enamel material such vitreous enamel which may be, by way of example, an admixture of quartz and feldspar, an alkali-boro-silicate glass or the like which may be suitably colored in a single color or a plurality of colors. As shown in FIG. 4, the pile of enameled frit or slip E is preferably contained in a rather shallow dish 22 preferably of copper. Furthermore, it should be understood that the more enamel material E applied to the tubing 14 the larger the finished bead will be.

Subsequent to the coating operation of FIG. 4, the enamel coated tubing 14 is then once again heated up in the manner shown in FIG. 5 using the torch 18 and during this heating operation the rod 17 and consequently the tubing 14 is rotated slowly in the direction of the arrow I while keeping the rod 17 level. As the enamel material E begins to melt as a result of the heat from the torch flame 19 the enamel material E is permitted to flow almost to the point where it is ready to drop off the tubing 14 however, the tubing 14 is turned slowly by manipulating the rod 17 so that the desired roundness in the finished bead is obtained as the enamel material E melts and fuses as shown in FIG. 6. When the bead B is formed the flame 19 is withdrawn from the position of FIG. 6 and cooling air is blown such as blowing from the mouth on the outer surface of the enamel layer 13 of the bead B so that the outer shell is cooled and the bead has assumed its final form.

Finally, the bead B is pushed off of the rod 17 immediately upon the cooling of the outer shell 13 but in accordance with the novel method of the invention, the bead B should be removed from the rod 17 rather promptly when the bead has assumed its final form but not too soon wherein the outer layer 13 is still plastic as the enamel material 13 will flow changing the shape of the bead shown in FIG. 6. The bead B is preferably removed from the rod 17 and placed in a suitable receptacle such as a copper dish similar to the copper dish 22 of FIG. 4 so that it eventually cools down completely.

Having thus described the preferred embodiment of the invention it should be understood that numerous structural modifications and adaptations may be resorted to without departing from the spirit of the invention.

What is claimed is:

1. A method of making enamel beads comprising the steps of, providing a tubular core member of metal, heating said tubular core member to a glowing state, coating the outer surface of said heated core member with an enamel flux plural times, heating said flux coated tubular core member to a glowing state, applying a particulate enamel material to the outer surface of said flux coated core member while in said heated state, heating said particulate enamel material on said core member to a molten state to uniformly distribute said enamel material on said core member thereby forming a bead, and cooling said enamel material following the formation of said bead.

2. A method in accordance with claim 1 including forming said tubular core member of copper.

3. A method in accordance with claim 1 including supporting said core member on a metal rod during said heating, coating, and applying steps.

4. A method in accordance with claim 3 including the step of removing said bead from said rod immediately after the outer shell of said bead is cooled.

5. A method in accordance with claim 1 wherein said coating step is carried out by rolling said heated core member in said enamel flux.

6. A method in accordance with claim 5 wherein said applying step is carried by rolling said flux coated core member in said particulate enamel material.

7. A method in accordance with claim 6 wherein said step of heating said particulate enamel material on said core member is carried out by rotating said core member in a flame.

8. A method in accordance with claim 7 including the step of providing a dish formed of copper and forming a pile of said particulate enamel material in said copper dish and wherein said applying step is carried out by rolling said flux coated core member in said pile of particulate enamel material.

9. A method in accordance with claim 8 wherein said coating step comprises rotating said heated bead and blowing on said heated bead briefly to cool the outer surface of said bead.

* * * * *